United States Patent [19]

Hackler

[11] Patent Number: 4,871,604

[45] Date of Patent: Oct. 3, 1989

[54] BINDER POWDER CARPET FIBER

[75] Inventor: Lewis R. Hackler, Colonial Heights, Va.

[73] Assignee: Allied-Signal Inc., Morris Township, Morris County, N.J.

[21] Appl. No.: 177,221

[22] Filed: Apr. 4, 1988

[51] Int. Cl.[4] ..... B32B 3/02; B32B 33/00

[52] U.S. Cl. ..... 428/96; 156/72; 427/189; 427/195; 427/208.2; 428/87; 428/95; 428/97; 428/370; 428/372

[58] Field of Search ..... 428/87, 95, 96, 97, 428/370, 372; 156/72; 427/189, 195, 208.2

[56] References Cited

U.S. PATENT DOCUMENTS 3,320,113 5/1967 Nicholas et al. ..... 428/87

4,731,274 3/1988 Ishida ..... 428/87

*Primary Examiner*—Marion C. McCamish

*Attorney, Agent, or Firm*—William H. Thrower

[57] ABSTRACT

Pile carpet of nylon, polyester, or other pile yarn, is coated with 0.1 to 5 weight percent, based on weight of the pile yarn of a heat-activated adhesive powder having a melting point within the range of 100° to 170° C., preferably 110° to 150° C. For nylon pile yarn a preferred adhesive powder is a ternary copolyamide selected from the group consisting of 6/6,6/12; 6/6,6/11; and 6/6,6/12,12. The powder is heat-activated, for example to 195° C. for about 60 seconds. The treated carpet displays enhanced carpet tuft appearance, improved resilience, carpet surface cleanness, and improved wear performance.

15 Claims, No Drawings

BINDER POWDER CARPET FIBER

BACKGROUND OF THE INVENTION

1. Field of the Invention

The invention relates to pile carpets comprising synthetic yarn or fibers, natural fibers, or blends thereof, and a heat-activated adhesive powder with a melting point substantially below that of the carpet fiber. In a process for production of carpet, adhesive powder may be applied and heat cured during the dyeing and finishing process steps causing the powder to completely melt and flow to points of intersecting fibers to create a bond upon subsequent cooling, thus altering the properties and performance of the finished carpet.

2. Description of Related Art

It has been known to blend non-adhesive fibers with potentially adhesive fibers to form a yarn or other textile structure, then to activate the potentially adhesive fibers to bond them to contacting fibers, thus modifying end-use properties of the yarn. U.S. Pat. No. 2,252,999 to Wallach, issued Aug. 19, 1941, provides a process wherein a yarn comprising an admixture of non-adhesive and potentially adhesive fiber is formed, the potentially adhesive fiber is activated, and the fibers compacted while in an adhesive condition so that they adhere to each other at points of contact. U.S. Pat. No. 3,877,214 to Van der Werf, issued Apr. 15, 1975, discloses a twist-free yarn comprising a polyamide fiber melting under a relatively low temperature as a bonding component. U.S. Pat. No. 3,494,819 to McAlister, issued Feb. 10, 1970 discloses a blend of fusible and non-fusible polyethylene terephthalate fibers incorporated into fabric, wherein the finished fabric is heated to fusion temperatures to provide improved pill resistance. U.S. Pat. No. 3,978,267 to Selwood, issued Aug. 31, 1976 discloses a substantially twistless compact yarn comprising a proportion of potentially adhesive fiber which have been activated to bond to contacting fibers.

The use of thermoplastic binder fibers in combination with structural fibers to form self-bonding nonwoven fabrics is known. U.S. Pat. No. 2,880,112 to Drelich, issued Mar. 31, 1959 discloses the use of nylon-6 to bond viscose rayon and other cellulosic materials to form washable nonwoven fabrics.

U.S. Pat. application Ser. No. 934,389 relates to a synthetic yarn blend for the carpeting, comprising a blend of nonadhesive fibers with heat-activated adhesive fibers with a melting point substantially below that of the nonadhesive fibers. In a process for production of carpet, exposure of the yarn to usual process conditions for twist setting the yarn causes the heat-activated adhesive fiber to melt substantially completely, losing its identity as a fiber, and to flow to points of intersecting fibers to create a bond upon cooling.

Cut-pile carpet is customarily produced from staple yarns or bulked continuous filament yarn. For example, staple fiber is conventionally carded, pinned, and spun or wrap spun into a singles yarn, which typically is twisted and plyed with similar yarn to form a 2-ply or 3-ply yarn construction. This yarn is twist set by utilizing one of several commercially available twist setting processes. In a typical process the yarn is passed through a heated chamber, while in a relaxed condition. The temperature of this process step is crucial to the proper twist setting of the base fiber, to obtain desired properties of the final carpet product. For nylon-6 base fiber, the conditions for this step are typically 195–200° C. with a residence time of about 60 seconds for the Suessen process and about 135–140 ° C. with a residence time of about 60 seconds for the Superba process.

Similarly, bulked continuous filament nylon yarn is produced according to various conventional methods. Twisting, entangling, or direct cabling may be utilized in various processes. For example, a 2-ply twisted yarn combining 2 ends of 1185 denier 70 filament yarn is prepared and subjected to conventional twist setting conditions, such as that for the staple yarn above or in an autoclave at 132° C. in saturated steam, with a residence time of about 60 seconds.

Multiple ends of the twist set yarns are incorporated into a fabric backing to produce a pile surface, for example by tufting, weaving, or fusion bonding, and conventionally finished to obtain the desired carpet product.

SUMMARY OF THE INVENTION

Pile carpet of nylon, polyester, or other pile yarn, is coated with 0.1 to 5 weight percent, based on weight of the pile yarn of a heat-activated adhesive powder having a melting point within the range of 100 to 170° C., preferably 110 to 150° C. For nylon pile yarn a preferred adhesive powder is a ternary copolyamide selected from the group consisting of 6/6,6/12; 6/6,6/11; and 6/6,6/12,12. The powder is heat-activated, for example to 195° C. for about 60 seconds. The treated carpet displays enhanced carpet tuft appearance, improved resilience, carpet surface cleanness, and improved wear performance.

DESCRIPTION OF THE PREFERRED EMBODIMENT

Applicant has discovered that by applying a minor proportion of heat-activated binder powder with substantially lower melting point than the base fiber onto the surface of cut-pile carpet, then applying sufficient heat to melt the binder powder causing it to adhere to the carpet fiber, much of the standard heat conditions required for finishing carpet will cause the binder powder to melt and flow to bind fibers and yarn together, thereby retaining the twist in cut-pile carpets. Carpets made with this invention can be improved in surface, aesthetics, hand, durability and wear performance. By careful selection of binder powder much of the desired improvement can be obtained utilizing normal heat sources required in carpet finishing.

The base carpet construction and fiber is selected and prepared from known products suitable for carpet use. Known pile yarns include wool, cotton, rayon, polypropylene, nylon-6, nylon-6,6, and polyester. Preferred base carpet fiber includes polyamide, particularly nylon-6 and nylon-6,6, and polyester fibers, particularly polyethylene terephthalate, in cut pile construction.

The binder powder is selected to provide good adhesion to the base carpet fiber. It is important that the melting point of the binder powder be in the range of 110 to 170° C., preferably 110 to 150° C., under ambient humidity conditions, and the powder particle size be 1 to 300 microns, preferably 25 to 100 microns. These ranges ensure that the binder powder will melt during conventional carpet finishing processes, yet will provide adequate adhesive properties along the fiber, where most effective.

A preferred class of binder powder for use with polyamide base carpet fiber are the ternary copolyamides, which fall within the required melting point range and provide good adhesion to the fiber. Preferred ternary copolyamides include the group consisting of 6/6,6/11; 6/6,6/12 and 6/6,6/12,12. Copolyamides of the 6/6,6/12 type and a process for their production are disclosed in U.K. Pat. No. 1,168,404, issued Oct. 22, 1969, to Inventa A.G., incorporated herein by reference. A melt bonding copolyamide adhesive powder is commercially available from EMS as GRILTEX 2G (melting range 130 to 140° C.) and from ATOCHEM as HO05 (melting range 120 to 130° C).

The binder powder is applied to the surface of the carpet by uniform application methods, or in pattern form as desired. The amount of binder powder applied will depend on the desired effect in the final carpet. A preferred amount is between 0.1 to 5.0 weight percent based on the weight of the carpet surface pile yarn. More preferred is 0.5 to 3.0 weight percent. An apparatus for applying the powder is commercially available from Nordson Corporation and is described as a unitized powder spray system utilizing a Flexi-Spray TM spray gun. Other suitable application methods are capable of obtaining a similar desired result, and include scatter coating, gravure printing, screen printing, and dispersion coating.

By selection of the thermally activated binder powder and powder particle size within the weight ranges and melting point ranges specified, it is possible to modify end-use properties of the finished carpet to improve wear resistance, resilience, reduced change of appearance over time and with use, and increased hand, luster and apparent value. Denier per filament, fiber cross-section, crimp type and frequency, yarn size and twist levels, surface finish, melt viscosity, softening point, melting point, dye affinity, and other properties are crucial to achieving ideal properties in the final product.

With the utilization of this invention, bond points are created between fibers which strengthen the final product and help prevent yarn twist backing out therefore improving appearance retention and other characteristics of the carpet. The normal processes used for carpet finishing, such as drying in a heated range after dyeing, and curing in an oven after the carpet secondary backing is attached, sufficiently motivates the molten binder powder to flow to the "touch points" of the base fibers, as a function of the melt flow properties of the binder powder and fiber surface characteristics. As the carpet emerges from the elevated temperature conditions the binder solidifies and encapsulates or bonds two or more base fibers together in a durable bond.

The resultant carpet can be of many forms, but a typical style would be about 36 ounces per square yard of face yarn, with an attached backing. Carpet construction would be typically $\frac{1}{8}$"gauge, $\frac{3}{8}$" high cut pile, and have 0.7 ounce per square yard of binder powder applied to the surface. The carpet would be dyed, dried, backcoated, and sheared using normal processing techniques.

The techniques of this invention provides pile carpet with enhanced carpet tuft resilience and improved wear resistance. The carpet has demonstrated ability to resist foot-marking, crushing, and shading.

EXAMPLE 1

Staple fiber (nylon-6) was spun into yarns of 3' s/1 cotton count (C.C.) having a twist of 4.8 twists per inch (TPI) "Z", and then two-plied with 4.4 TPI "S" of twist using conventional processing methods. The resultant 3s/2 C.C. yarn was twist-set by a conventional Suessen twist-setting process at 195° C. Multiple ends of this yarn were tufted into cut pile carpet. Binder powder (ATOCHEM HO05 copolyamide, melting point range 120 to 130° C.) was applied to the surface of the carpet in an amount of 2 weight percent based on the weight of the pile yarn and passed through an infrared oven at 150° C. to cause the binder powder to adhere to the base fiber. The resulting carpet was dyed, dried, backcoated with latex and secondary backing, and cured using conventional processing methods. The carpet treated with the binder powder displayed enhanced carpet tuft resilience, a cleaner firmer surface, and better wear resistance than an untreated carpet control.

EXAMPLE 2

Carpets also may be produced from bulked continuous filament (BCF) yarns, and carpets thus made can be improved in surface, aesthetics, hand, or durability and wear by using this invention. In this example BCF nylon 6 yarn of 1165 denier is twisted 3.75 TPI "Z" and two-plied with 3.75 TPI "S". The resultant yarn is twist-set by conventional Superba twist-setting at 280° F. (137° C.) and tufted into conventional cut pile carpeting. Binder powder (ATOCHEM HO05 copolyamide, melting point range 120 to 130° C.) was applied to the carpet in an amount of 2 weight percent based on the weight of the pile yarn, then passed through an infrared oven to "tack" the binder powder to the base fiber. All other processing steps simply used normal processing techniques to obtain the desired effect. The carpet treated with binder powder had a firmer hand, more resilience, a cleaner surface, appeared to have more value, and gave improved performance and appearance retention than an untreated carpet control.

What is claimed:

1. Tufted pile carpet having enhanced carpet tuft resilience and improved wear resistance comprising tufted pile yarn selected from the group consisting of wool, cotton, rayon polypropylene, nylon-6, nylon-6,6 and polyester, said pile yarn comprising points of intersecting fiber bonded with 0.1 to 5.0 weight percent, based on weight of the pile yarn, of a heat-activated adhesive with a melting point range of 110 to 170°C.

2. The tufted pile carpet of claim 1 wherein said heat-activated adhesive has a melting range of 110 to 150°C. and is present in an amount of 0.5 to 3.0 weight percent.

3. The tufted pile carpet of claim 1 wherein said pile yarn is selected from the group consisting of nylon-6 and nylon-6,6.

4. The tufted pile carpet of claim 3 wherein said heat-activated adhesive is a ternary copolyamide.

5. The tufted pile carpet of claim 4 wherein said ternary copolyamide has a melting point range of 110 to 150°C.

6. The tufted pile carpet of claim 4 wherein said ternary copolyamide is selected from the group consisting of 6/6,6/11; 6/6,6/12; and 6/6,6/12,12.

7. In a method of producing pile carpet comprising incorporating pile yarn selected from the group consisting of wool, cotton, rayon, polypropylene, nylon-6, nylon-6,6 and polyester into a fabric backing to produce a pile surface, the improvement comprising applying to said pile surface 0.1 to 5.0 weight percent, based on weight of the pile yarn, of heat-activated binder powder with a melting point range of 110 to 170° C. under ambient humidity conditions and with a particle size range of 1 to 300 microns, then heating sufficiently to substantially melt said binder powder, then cooling to solidify said melt to create a bond between intersecting fiber within said yarn, thereby providing enhanced carpet tuft resilience and improved wear resistance.

8. The method of claim 7 wherein said binder powder has a melting point range of 110 to 150° C.

9. The method of claim 8 wherein said binder powder has a particle size range of 25 to 100 microns.

10. The method of claim 9 wherein 0.5 to 3.0 weight percent binder powder is applied to said pile surface.

11. The method of claim 7 wherein said pile yarn is selected from the group consisting of nylon-6 and nylon-6,6.

12. The method of claim 11 wherein said binder powder is a ternary copolyamide.

13. The method of claim 12 wherein said ternary copolyamide is selected from the group consisting of 6/6,6/11; 6/6,6/12; and 6/6,6/12,12.

14. The method of claim 13 wherein said binder powder has a melting point range of 110 to 150° C.

15. The method of claim 14 wherein said binder powder has a particle size range of 25 to 100 microns.

* * * * *